US007671536B2

(12) United States Patent
Takagaki et al.

(10) Patent No.: US 7,671,536 B2
(45) Date of Patent: Mar. 2, 2010

(54) ARC TUBE FOR DISCHARGE LAMP DEVICE

(75) Inventors: Michio Takagaki, Shizuoka (JP); Takeshi Fukuyo, Shizuoka (JP); Akira Homma, Shizuoka (JP)

(73) Assignee: Koito Manufacuturing Co., Ltd., Tokyo (JP)

( * ) Notice: Subject to any disclaimer, the term of this patent is extended or adjusted under 35 U.S.C. 154(b) by 511 days.

(21) Appl. No.: 11/593,524

(22) Filed: Nov. 7, 2006

(65) Prior Publication Data

US 2007/0103084 A1 May 10, 2007

(30) Foreign Application Priority Data

Nov. 8, 2005 (JP) ..... P.2005-323136

(51) Int. Cl.
*H01J 17/04* (2006.01)

(52) U.S. Cl. ..... 313/631; 313/637

(58) Field of Classification Search ..... 313/631–637
See application file for complete search history.

(56) References Cited

U.S. PATENT DOCUMENTS 5,905,340 A * 5/1999 Karlotski et al. ..... 313/633
6,891,332 B1 * 5/2005 Irisawa et al. ..... 313/631
2004/0036393 A1 * 2/2004 Eastlund et al. ..... 313/26
2005/0134179 A1 * 6/2005 Takagaki et al. ..... 313/631

FOREIGN PATENT DOCUMENTS

JP 2001-15067 A 1/2001
JP 2004-220880 A 8/2004
JP 2005-142072 A 6/2005
JP 2005-183164 A 7/2005

* cited by examiner

*Primary Examiner*—Nimeshkumar D. Patel
*Assistant Examiner*—Mary Ellen Bowman
(74) *Attorney, Agent, or Firm*—Sughrue Mion, PLLC

(57) ABSTRACT

A mercury-free arc tube for a discharge-lamp device having a sealed glass chamber with at least metallic halide for main light emission and rare gas. Both end openings of a glass tube are pinch-sealed and electrode bars are provided so as to oppose to each other. Each electrode bar has such a concentric stepped shape that a tip side region is thicker than a base side region, the volume V of an electrode embedded region is from 0.25 to 0.42 $mm^3$ and the total volume of the electrode bar is from 0.4 to 0.6 $mm^3$.

12 Claims, 6 Drawing Sheets

FIG. 7
$4ScI_3 + 3SiO_2 \rightarrow 2Sc_2O_3 + 3SiI_4$ ··· DEVITRIFICATION
$nW + SiI_4 \rightarrow SiW_n + 2I_2$ ··· ELECTRODE DEFORMATION
(LOW MELTING POINT ALLOY)
$4ScI_3 + 3ThO_2 \rightarrow 2Sc_2O_3 + 3ThI_4$ ··· THORIA VANISHING
FIG. 8 (a)
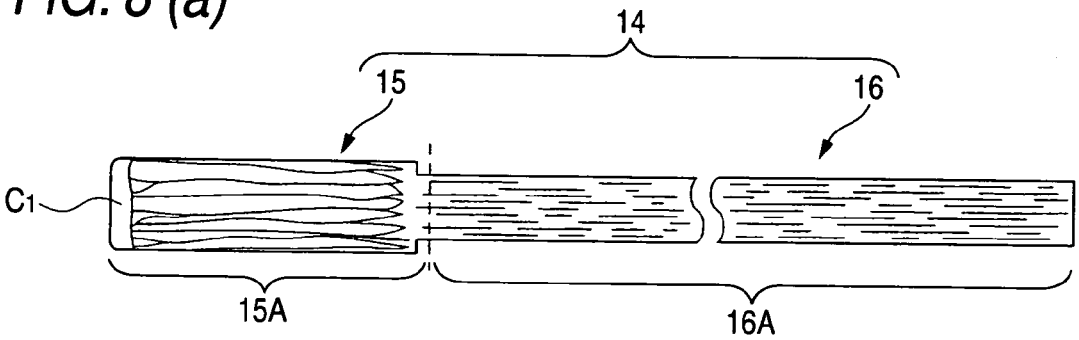
FIG. 8 (b)
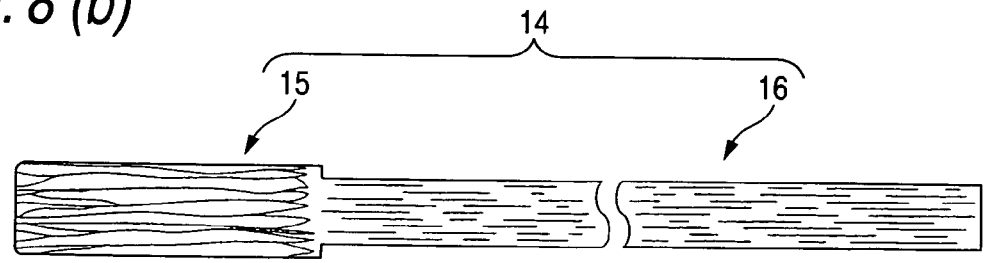

ARC TUBE FOR DISCHARGE LAMP DEVICE

CROSS-REFERENCE TO RELATED APPLICATIONS

This application claims priority from Japanese Patent Application No. 2005-323136, filed Nov. 8, 2005, in the Japanese Patent Office, the entire disclosure of which is incorporated herein by reference.

BACKGROUND OF THE INVENTION

1. Field of the Invention

This invention relates to a mercury free arc tube for a discharge-lamp device provided with a sealed glass chamber in which at least a metallic halide for main light emission is sealed as well as a rare gas by pinch-sealing both end openings of a glass tube and electrode bars are provided so as to oppose to each other. This invention particularly relates to a mercury free arc tube for a discharge-lamp device provided with electrode bars each having such a concentric stepped shape in which a cross sectional area of a tip side region projecting into the sealed glass chamber is larger than that of a base side region sealed on a pinch-sealed portion.

2. Description of the Background Art

FIG. 9 illustrates a related art discharge lamp device. A front end of an arc tube 5 made of quartz glass is supported by a single lead support 2 which projects forward of an insulating base 1. A rear end of the arc tube 5 is supported by a concave portion 1*a* of the insulating base 1. An area adjacent to the rear end of the arc tube 5 is held by a metallic supporting member 4 secured to a front face of the insulating base 1. Lead wire 8 on the front end side led out from the arc tube 5 is fixed to the lead support 2 by welding. On the other hand, the lead wire 8 on the rear end side passes through a bottom wall 1*b* on which the concave portion 1*a* of the base 1 is formed and fixed to a terminal 3 formed on the bottom wall 1*b* by welding. Symbol G denotes a cylindrical glass globe for cutting off a component of ultraviolet rays, which have a wavelength that is harmful to the human body and which is emitted from the arc tube 5. The globe G is integral with the arc tube 5.

The arc tube 5 has a structure in which between a pair of front and rear pinch-sealed portions 5*b*, 5*b*, a sealed glass chamber 5*a* is formed in which electrode bars 6, 6 are opposite to each other and a light emitting material (halide of Na or Sc and Hg) is sealed with rare gas. Within each of the pinch-sealed portions 5*b*, a molybdenum foil 7 is deposited for connecting the electrode bars 6 projecting into the sealed glass chamber 5*a* and the lead wire 8 led out from the pinch-sealed portion 5*b*, thereby assuring hermeticity of the pinch-sealed portions 5*b*.

Specifically, the electrode bar 6 is preferably made of tungsten having excellent heat resistance and high endurance. However, tungsten has a linear expansion coefficient which is greatly different from that of the quartz glass constituting the arc tube and poor familiarity with the quartz glass, thus giving inferior hermeticity. In view of this, by connecting the molybdenum foil 7 having excellent expandability and flexibility and better familiarity with the quartz glass to the electrode bar 6 of tungsten and sealing the molybdenum foil 7 with the pinch-sealed portion 5*b*, the hermeticity of the pinch-sealed portion 5*b* is assured.

However, a large temperature difference in the pinch-sealed portion 5*b* occurs between "on" and "off" of the arc tube. Between the electrode bar and quartz glass which are largely different in their linear expansion coefficient, thermal stress is generated during the "on" state of the arc tube.

Particularly, since the arc tube in recent years is designed so that it can be instantaneously turned on, the rate of temperature rise is large and so the thermal stress is abruptly generated. If this status is repeated by on/off of the arc tube, in the pinch-sealed portion (quartz glass layer) 5*b* which seals the electrode bar 6, cracks (hereinafter referred to as longitudinal cracks) extending radially from the electrode bar 6 are generated so that the sealed substance will leak. This leads to a problem of poor lighting or reduction of the life of the arc tube.

In order to cope with this problem, Japanese Patent Unexamined Patent Publication JP-A-2001-15067 has been proposed on the basis of the idea that the longitudinal crack is more difficult to be generated in the quartz glass layer of the pinch-sealed portion 5*b* in the case where residual compressive distortion remains over a predetermined region, because the thermal stress generated in the quartz glass layer of the pinch-sealed portion is dispersed with the rise of temperature due to lighting of the arc tube, thereby extending the life of the arc tube.

More specifically, JP-A-2001-15067, as seen from FIG. 10, proposes a structure in which on a face in intimate contact with the electrode bar 6 of the quartz glass layer of the pinch-sealed portion 5*b*, a residual compressive distortion layer 9 is formed over a predetermined wide range. Also, between the residual compressive distortion layer 9 and its encircling glass layer, a bead crack 9*a* is formed. Note that the bead crack 9*a* is a crack extending circumferentially and axially so as to surround the residual compressive distortion layer 9. In this structure, when the arc tube is turned on, the thermal stress generated in the interface between the electrode bar 6 and the quartz glass layer is absorbed and dispersed by the residual compressive distortion layer 9 and the bead crack 9*a* and conducted toward the quartz glass layer. Thus, the longitudinal crack leading to leakage of the sealed substance is not generated in the quartz glass layer of the pinch-sealed portion 5*b*.

Mercury (Hg) sealed in the sealed glass chamber 5*a* is a very useful substance to keep a predetermined tube voltage and to reduce the quantity of collisions of electrons with the electrode to thereby alleviate damage of the electrode. However, since Hg is harmful to the environment, in recent years, development of a "mercury-free arc tube" in which Hg is not contained has been advanced.

In the case of a "mercury-free" arc tube, the tube voltage is lowered so that the tube electric power necessary for discharging cannot be obtained. So, in order to increase the tube electric power, it is necessary to increase the current (tube current) to be supplied to the arc tube. The load of the electrode is correspondingly increased so that the electrode is injured (consumed or blacks). This leads to a problem of reduction in the light emission efficiency and extinction of arc. This problem can be solved by increasing the diameter of the electrode bar 6. However, the following situation may occur. Namely, if the electrode bar 6 is too thick, a difference in the quantity of heat-shrinkage between the electrode bar and the quartz glass layer becomes great, so that they will be separated from each other at the interface therebetween. As a result, a residual compressive distortion layer 9 and bead crack 9*a* around the electrode bar 6 in the quartz glass layer of the pinch-sealed portion 5*b* having an optimum size capable of absorbing/alleviating the thermal stress generated when the arc tube is turned on cannot be formed. Accordingly, by "on/off" of the arc tube, the longitudinal crack leading to leakage of the sealed substance will be generated in the pinch-sealed portion 5*b*.

Mercury-free arc tubes disclosed in Japanese Patent Unexamined Publications JP-A-2005-142072 and JP-A-2005-183164 provide a solution of the contradictory problem of injury of the electrode and generation of the longitudinal crack. In the JP-A-2005-142072 and JP-A-2005-183164, by adopting a stepped electrode bar in which, as shown in FIG. 11, the outer diameter of the tip side region 6*a* of the electrode bar projected into the sealed glass chamber is made larger than that of the base side region 6*b* of the electrode bar deposited on the pinch-sealed portion. That is, the outer diameter of the base side region 6*b* of the electrode bar deposited on the pinch-sealed portion is made smaller than that of the tip side region 6*a* of the electrode bar projected into the sealed glass chamber.

However, the following matter has been confirmed. In the mercury-free arc tube in which the pressure of rare gas within the sealed glass chamber is required high and the turn-on power is required high, particularly when the discharge lamp is actuated, an electric current and heat current, which flows from the electrode tip side region of the electrode bar having a larger diameter toward the electrode base side region having a smaller diameter deposited on the pinch-sealed portion, will be abruptly generated. So, the adoption of only the stepped electrode bar as in JP-A-2005-142072 and JP-A-2005-183164 is insufficient to surely suppress occurrence of flicker (flicker of arc) leading to the reduction of the life of the arc tube and the longitudinal crack or "foil float" in the pinch-sealed portion. Note that the foil float means a case where a gap is generated between the molybdenum foil and the glass layer.

SUMMARY OF THE INVENTION

In view of the above, the inventors of this invention have paid attention to the volume (capacity) of the base side region having a smaller diameter deposited on the pinch-sealed portion of the stepped electrode bar. The inventors have investigated the relationships between the volume (capacity) of the electrode bar base side region and occurrence of flicker and between the volume (capacity) of this region and occurrence of the longitudinal crack and "foil float" in the pinch-sealed portion. The results as shown in FIGS. 3 and 4 were acquired, and the following facts were obtained.

Specifically, if the volume (capacity) is increased, thermal conduction from the electrode bar to the pinch-sealed portion is promoted so that the temperature of the electrode tip side region does not become excessively high. Thus, the deformation of the electrode and occurrence of flicker are suppressed. In addition, the heat capacity in the region deposited on the pinch-sealed portion of the electrode bar is relatively large so that the temperature of the molybdenum foil connected to the electrode bar does not rise correspondingly. Thus, the thermal stress generated between the glass layer and the molybdenum foil is small and so occurrence of the foil float is suppressed.

Further, it was also obtained that in order to suppress the occurrence of the longitudinal crack in the pinch-portion, the volume (capacity) of the region deposited on the pinch-sealed portion of the electrode bar is desirably not larger than a predetermined range. In order to suppress occurrence of the longitudinal crack, the residual compressive distortion layer and bead crack formed around the electrode bar in the pinch-sealed portion are desirably formed within an optimum range. In this case, if the volume (capacity) of the region deposited on the pinch-sealed portion of the electrode bar is too small, the area of the glass layer and the electrode bar is also small and the residual compressive distortion layer (bead crack) generated in the glass layer is also too small. On the other hand, if the volume (capacity) of this region of the electrode bar is too large, the circumferential and axial areas of the interface between the glass layer and the electrode bar are large. Thus, on the process in which the pinch-sealed portion is cooled after pinch-sealing, a difference in the quantity of heat-shrinkage between the electrode bar and the quartz glass layer becomes great, so that the residual compressive distortion layer and bead crack cannot be suitably formed in the quartz glass layer. Particularly, where the residual compressive distortion layer and the bead crack are large, when the arc tube is turned on, the crack extending radially from the end in the circumferential direction of the bead crack is generated. That is, the longitudinal crack is generated.

As described above, it was confirmed that if the volume (capacity) of the base side region deposited on the pinch-sealed portion of the stepped electrode bar is placed within a predetermined range, occurrence of flicker and occurrence of the longitudinal crack or foil float in the pinch-sealed portion can be prevented, that is, increasing the life of the arc tube can be realized.

This invention has been accomplished on the basis of the problem of the prior art described above and the inventor's knowledge. An object of this invention is to provide a discharge-lamp device using a mercury-free arc tube which is effective to suppress the occurrence of flicker, longitudinal crack and foil float and can have a long life.

According to a first aspect of the invention, there is provided a mercury-free arc tube for a discharge-lamp device comprising:

- a sealed glass chamber in which at least metallic halide for main light emission and rare gas are pinch-sealed by pinch-sealed portions provided on both end openings of a glass tube; and
- electrode bars that are provided so as to oppose to each other and respectively comprises:
  - a tip side region that projects into the sealed glass chamber; and
  - a base side region that is deposited on the pinch-sealed portion,
- wherein the respective electrode bars has such a concentric stepped shape that a cross sectional area of the tip side region is larger than that of the base side region, and
- a volume V of the base side region deposited on the pinch-sealed portion is from 0.25 to 0.42 $mm^3$.

The "stepped-shape" is not limited to a shape in which a level-difference portion between the electrode bar tip side region and the electrode bar base side region is formed in a right-angle shape, but includes a tapered shape or slope shape with a level difference being gradually changing.

Operation

In a mercury-free arc tube, in order to compensate for the lack of mercury in the sealed glass chamber, the sealing pressure of inner gas (e.g., Xe) is set at 10 to 15 atm, which is higher than in the case of the mercury-sealed arc tube (usually, 5 to 8 atm). In order to acquire the tube electric power necessary for discharging, the turn-on power (input power) is set at 70 to 85 W, which is higher than in the case of the mercury-sealed arc tube (usually, 60 to 70 W). Further, the current (tube current) to be supplied to the arc tube is set at 2.7 to 3.2 A, which is higher than in the case of the mercury-sealed arc tube (usually, 2.2 to 2.6 A). Thus, the load acting on the electrode is increased and the electrode is likely to be injured. In order to avoid such an inconvenience, the total volume (capacity) is set at 0.4 to 0.6 $mm^3$, larger than in the case of the mercury-sealed arc tube (usually, 0.25 to 0.35 $mm^3$). Further, since the electrode bar tip side region which may be injured has a larger diameter, this region is correspondingly resistant to injury. Further, if the diameter of the electrode bar base side region deposited on the pinch-sealed portion is too large (too thick), the residual compressive distortion layer and bead crack optimum to suppress occurrence of the longitudinal crack cannot be formed. Nevertheless, its diameter is smaller (thinner) than that of the electrode bar tip side region so that the residual compressive distortion layer and bead crack are formed around the electrode bar, thereby making it difficult to generate the longitudinal crack in the pinch-sealed portion.

In this way, as in the JP-A-2005-183164, by causing the electrode bar to have a concentric stepped shape in which the region projecting into the sealed glass chamber (tip side region) is thicker than the region deposited on the pinch-sealed portion (base side region) (i.e., a stepped electrode bar in which the outer diameter of the electrode bar base side region deposited on the pinch-sealed portion is smaller than that of the electrode bar tip side region), the injury of the electrode and longitudinal crack in the pinch-sealed portion can be suppressed to a degree.

However, as shown in FIGS. 3 and 4, in order to surely suppress the occurrence of flicker and the occurrence of longitudinal crack and foil float in the pinch-sealed portion (realization of the long life of the arc tube), the volume V of the electrode bar base side region provided in the pinch-sealed portion should be within a range from 0.25 to 0.42 $mm^3$.

Specifically, the volume V of the electrode bar base side region provided in the pinch-sealed portion to surely suppress the occurrence of flicker and the occurrence of longitudinal crack and foil float in the pinch-sealed portion (realization of the long life of the arc tube) can be explained as follows assuming that the cross-sectional area of the small-diameter base side region of the stepped electrode bar is A, the length of region deposited on the pinch-sealed portion of the electrode bar is L, the volume (capacity) of the region deposited on the pinch-sealed portion of the electrode bar is V, and the volume of the region projecting into the sealed glass chamber of the electrode bar is v.

Regarding deformation of electrode and occurrence of flicker:

If the volume V (=A·L) of the region deposited on the pinch-sealed portion of the electrode bar is made large, thermal conduction from the electrode bar to the pinch-sealed portion is promoted so that the temperature of the electrode bar tip side region does not become excessively high. Thus, the deformation of the electrode and occurrence of flicker are suppressed. In the characteristic of a flicker occurrence time (that is, time taken until flicker occurrence after the arc tube has been turned on; and the average life of the arc tube) versus the volume V, as shown in FIG. 3, if the limit of the flicker occurrence time (average life of the arc tube) is set at 2500 hours (generally desired), V is desirably 0.25 $mm^3$ or more.

Regarding foil float:

If the volume V (=A·L) of the region deposited on the pinch-sealed portion of the electrode bar is made large, the heat capacity of the region deposited on the pinch-sealed portion of the electrode bar is relatively large so that the temperature of the molybdenum foil connected to the electrode bar does not rise correspondingly. Thus, the thermal stress generated between the glass layer and the molybdenum foil is small and so occurrence of the foil float is correspondingly suppressed. In the characteristic of occurrence rate of the foil float versus V (see one-dot transversal chain line in FIG. 4), if the limit of the occurrence rate of defectives is set at 0.5%, V is desirably 0.25 $mm^3$ or more.

Regarding longitudinal crack:

In order to suppress occurrence of the longitudinal crack in the pinch-sealed portion, the residual compressive distortion layer and bead crack formed around the electrode bar in the pinch-sealed portion are desirably formed within an optimum range. In this case, if the volume (capacity) V of the region deposited on the pinch-sealed portion of the electrode bar is too small, the area of the interface between the glass layer and the electrode bar is also small and the residual compressive distortion layer (bead crack) generated in the glass layer is also too small. So, the volume (capacity) V of the above region of the electrode bar is desirably large. However, if the volume (capacity) V of this region of the electrode bar is too large, the circumferential and axial areas of the interface between the glass layer and the electrode bar are large. Thus, in the process in which the pinch-sealed portion is cooled after pinch-sealing, difference in the quantity of heat-shrinkage between the electrode bar and the quartz glass layer becomes great, so that the residual compressive distortion layer and bead crack cannot be suitably formed in the quartz glass layer. Particularly, where the residual compressive distortion layer and the bead crack are large, when the arc tube is turned on, the crack extending radially from the end in the circumferential direction of the bead crack is generated, that is, it has been found that the longitudinal crack is generated. In the characteristic of the occurrence rate of the longitudinal crack versus V (solid line in FIG. 4), if the limit of the occurrence rate of defectives is set at 0.5%, V is desirably 0.42 $mm^3$ or less.

For the reasons described above, in order to surely suppress the occurrence of flicker and the occurrence of the longitudinal crack and the foil float in the pinch-sealed portion (realization of the long life of the arc tube), the volume V of the electrode bar base side region deposited on the pinch-sealed portion is desirably placed within a range from 0.25 to 0.42 $mm^3$.

Further, according to a second aspect of the invention, there is provided the mercury-free arc tube for the discharge-lamp device as set forth in the first aspect of the invention, wherein assuming that a volume of the tip side region of the electrode bar that projects into the sealed glass chamber is v, V+v is from 0.40 to 0.60 $mm^3$ and V·v is from 0.03 to 0.09 $mm^6$.

Operation

In the characteristic of the occurrence rate of defectives (electrode consumption) versus the total volume (V+v) of the electrode (see solid line in FIG. 5), if the limit of the occurrence rate of defectives is set at 0.5%, V+v is desirably 0.40 $mm^3$ or more. Further, in the characteristic of the occurrence rate of defectives (shift of a luminescent spot while the arc tube is stably kept "on", hereinafter referred to as shift of the luminescent spot) versus the total volume (V+v) of the electrode (see one-dot chain line in FIG. 5), if the limit of the occurrence rate of defectives is set at 0.5%, V+v is desirably 0.60 $mm^3$ or less.

In the characteristic of the occurrence rate of defectives (electrode consumption) versus the product (V·v) of the volume V of the region deposited on the pinch-sealed portion of the electrode bar and volume v of the region projecting into the sealed glass chamber of the electrode bar (see solid line in FIG. 6), if the limit of the occurrence rate of defectives (electrode consumption) is set at 0.5%, V·v is desirably 0.03 $mm^6$ or more. Further, in the characteristic of the occurrence rate of defectives (shift of the luminescent spot) versus V·v characteristics (see one-dot chain line in FIG. 6), if the limit of the occurrence rate of defectives is set at 0.5%, V·v is desirably 0.09 $mm^6$ or less.

Further, according to a third aspect of the invention, there is provided the mercury-free arc tube for the discharge-lamp device as set forth in the first aspect of the invention, wherein the electrode bar is a potassium-doped tungsten electrode bar, on which vacuum heat-treatment with temperature range of 1200° C. to 2000° C. is performed and which is subjected to an aging process of repeating "ON" and "OFF" after assembling the arc tube, wherein a longitudinal cross sectional crystal structure of the tip side region of the electrode bar is formed of a non-sagging crystal structure and wherein a tip portion of the tip side region of the electrode is formed of a single crystal having a diameter approximately equal to that of the tip side region of the electrode bar.

Operation

Each the electrode bars oppositely provided within the sealed glass chamber in related art devices is formed of an electrode bar made of thoriated tungsten (generally referred to as "thori-tun"). So, owing to the thoria ($ThO_2$) contained in the tungsten, flicker (arc flicker) is likely to occur. FIG. 7 is a view indicating the mechanism (chemical reaction) of flicker occurrence in the thoriated tungsten electrode bar. In this chemical reaction, it is supposed that owing to deformation of the electrode and vanishing of thoria, a re-ignition voltage rises so that flicker occurs. Further, in order to provide the stepped electrode bar, usually, the processing of cutting a pillar-like electrode into a stepped shape is required so that correspondingly, impurities will be deposited on or water will be absorbed by the surface of the electrode bar. So, flicker is more likely to occur.

However, in the potassium-doped tungsten electrode bar, the flicker (arc flicker) will not occur owing to thoria ($ThO_2$). Further, by previously executing the vacuum heat-treatment within a temperature range of 1200° C. to 2000° C. before pinch sealing, the impurities deposited on or the water absorbed by the electrode surface can be also removed. In this case, the longitudinal cross sectional crystal structure of the entire region of the electrode bar is a textile crystal structure which has an excellent strength and so is difficult to break.

Further, in the potassium-doped tungsten electrode bar, on which is performed an aging process of repeating "ON" and "OFF" after the arc tube has been completed, the longitudinal cross section crystal structure of the large-diameter tip side region projecting into the sealed glass chamber of the electrode bar is formed of a non-sagging crystal structure in which the textile crystal before the aging process has grown (has become coarse) as shown in FIG. 8A. In addition, its tip is formed of a single crystal (see symbol C1 in FIG. 8A) grown (become coarse) so as to be apparently different from the non-sagging crystal.

The longitudinal cross sectional crystal structure of the electrode bar tip side region is excellent in strength against not only the load axially acting but also the load transversally acting. So, even when vertical vibration is conducted to the electrode, it will not break.

Further, in the mercury-free arc tube, in order that the tube electric power necessary for discharging is obtained, it is necessary to increase the current (tube current) to be supplied to the arc tube, thereby increasing the tube electric power. The electrode tip correspondingly reaches a high temperature. Therefore, if the ON/OFF of the arc tube is repeated, the crystal in the vicinity of the electrode tip will grow (crystal size will expand) so that the face shape of the electrode tip changes owing to shifting of a crystal interface position. Thus, the "decline" of the luminescent spot such as displacement of the luminescent spot (the luminescent spot of discharging shifts whenever the arc tube is turned on/off) or shift of the luminescent spot (the luminescent spot shifts while the arc tube is stably kept "on") occurs. This leads to the impossibility of acquiring appropriate distributed light and to reduction of central brightness of a vehicle-use head lamp. In accordance with the third aspect of the invention, since the longitudinal cross section of the electrode bar tip is formed of a single structure so that the decline of the luminescent spot during discharging leading to flicker (arc flicker) is suppressed.

In accordance with the mercury-free arc tube for the discharge-lamp device according to this invention, there is provided a discharge-lamp device use mercury-free arc tube which can surely suppress occurrence of flicker, and longitudinal crack and foil float in a pinch-sealed portion and can have a long life.

In accordance with the second aspect of the invention, the degree of consumption of the electrode is low and the movement of the luminescent spot is small so that the mercury-free arc tube for the discharge-lamp device having a long life and excellent visibility can be provided.

In accordance with the third aspect of the invention, the decline of the luminescent spot during discharging does not occur and flicker occurrence is further suppressed so that the e discharge-lamp device use mercury-free arc tube having a longer life can be provided.

BRIEF DESCRIPTION OF THE DRAWINGS

FIG. 7 is a view indicating the mechanism (chemical reaction) of flicker occurrence in the arc tube equipped with an electrode formed of a thoriated tungsten electrode bar;

FIG. 8A is a view showing the enlarged longitudinal cross sectional crystal structure of the electrode bar tip side region when a potassium-doped tungsten electrode bar is subjected to an aging process after vacuum heat-treatment within a range of 1200° C. to 2000° C.;

FIG. 8B is view showing the enlarged longitudinal cross section crystal structure of the electrode bar tip side region when a thoriated tungsten electrode bar is subjected the same processing as FIG. 8A;

DETAILED DESCRIPTION OF EXEMPLARY EMBODIMENTS OF THE INVENTION

Figure 1:
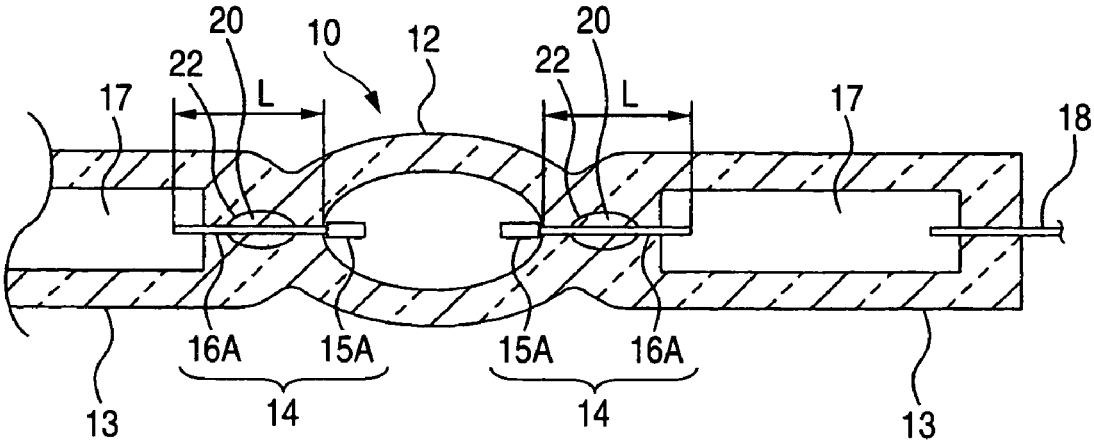
FIG. 1 is a longitudinal cross sectional view of an arc tube for a discharge-lamp device according to a first exemplary embodiment of the invention.
Figure 2:
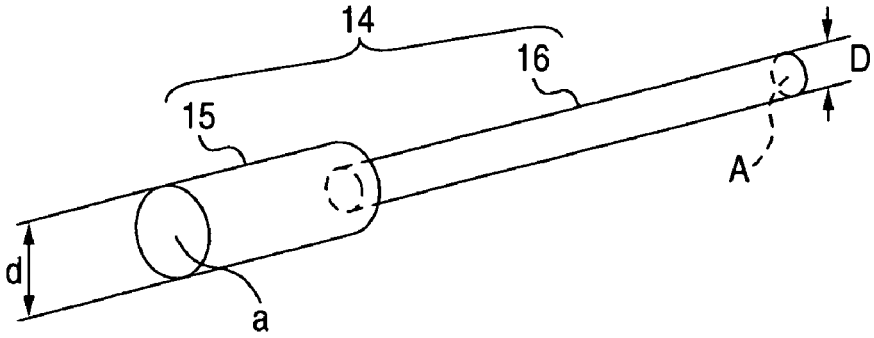
FIG. 2 is an enlarged side perspective view of an electrode bar of the arc tube of FIG. 1.
Figure 3:
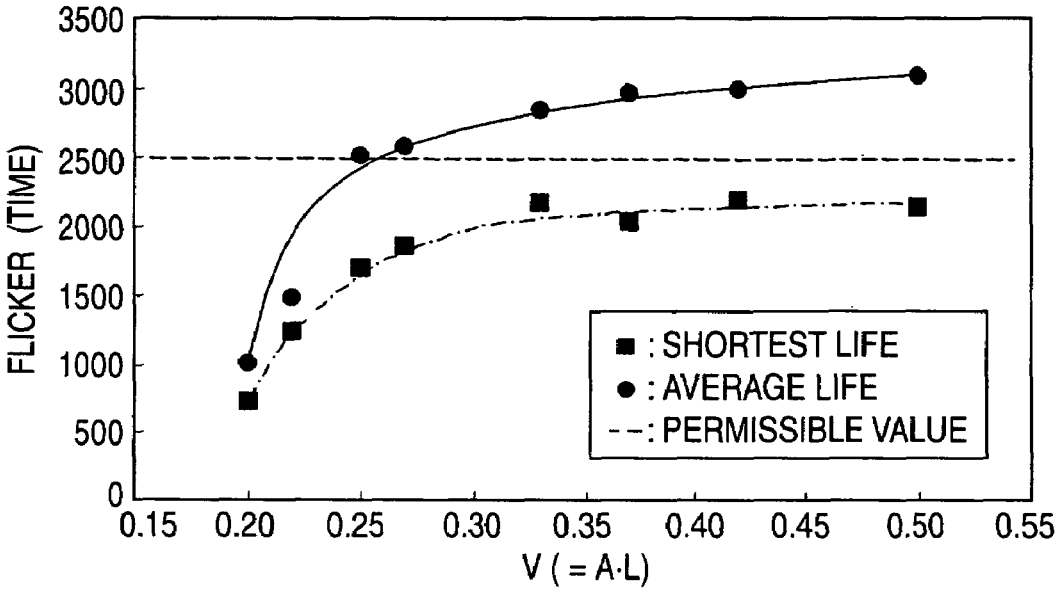
FIG. 3 is a graph showing a characteristic of flicker occurrence time (life of the arc tube) versus the volume of a region deposited on a pinch-sealed portion of the electrode bar.
Figure 4:
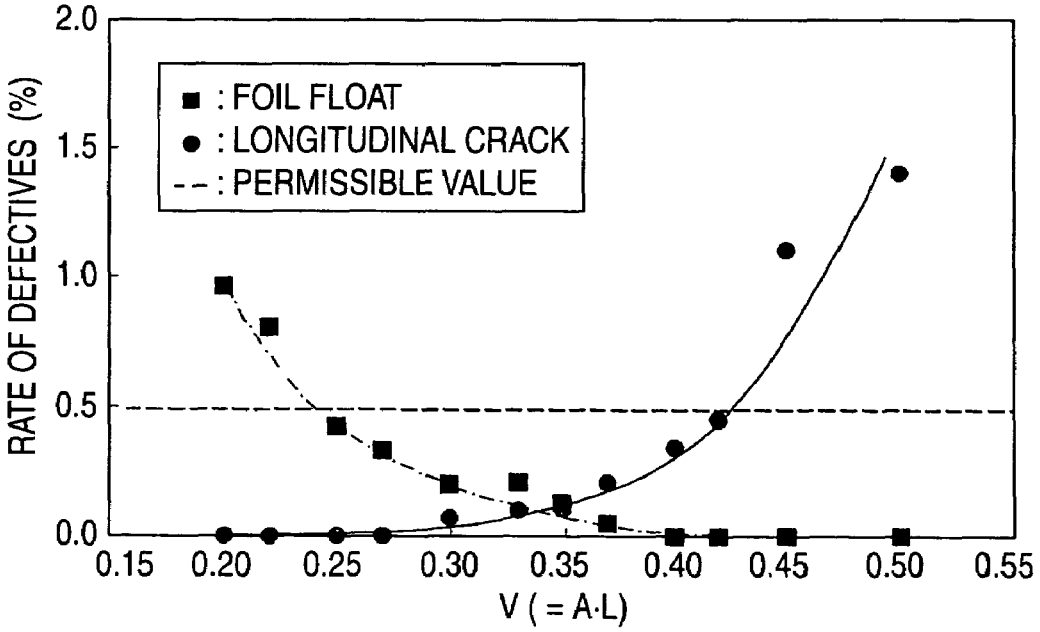
FIG. 4 is a graph showing the characteristics of occurrence rate of foil float and longitudinal crack versus volume of region deposited on a pinch-sealed portion of an electrode bar.
Figure 5:
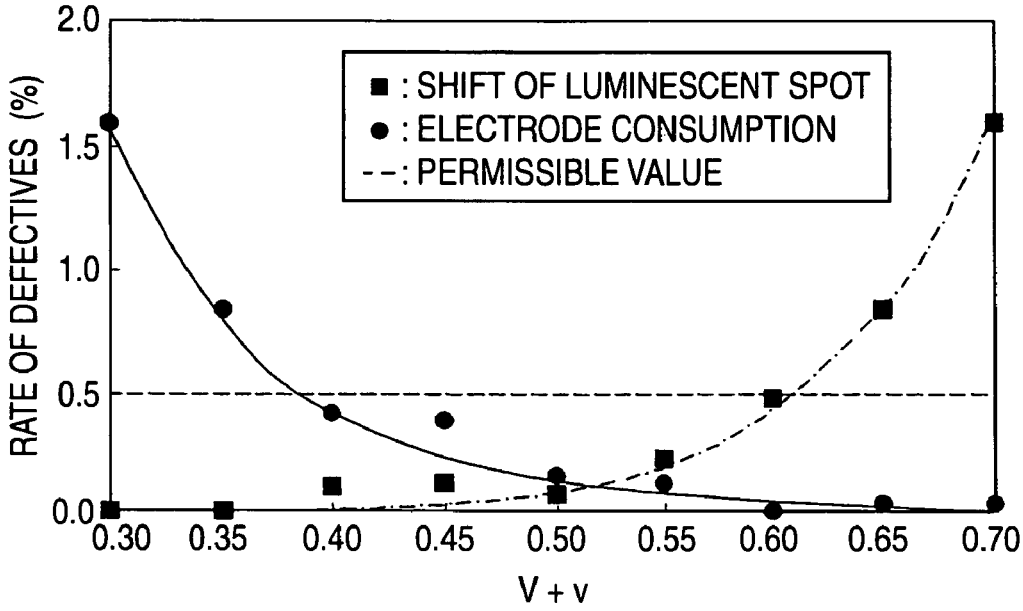
FIG. 5 is a graph showing the characteristics of occurrence rate of defectives due to electrode consumption and of defectives due to the shift of a luminescent spot versus volume of the region deposited on the pinch-sealed portion of the electrode bar.
Figure 6:
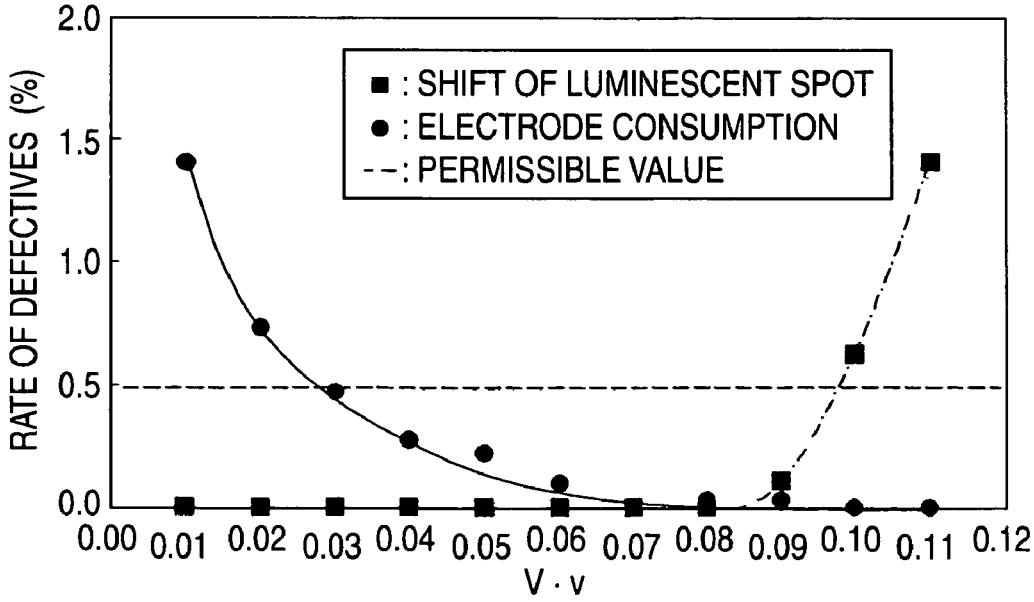
FIG. 6 is a graph showing the characteristics of occurrence rate of defectives due to electrode consumption and of defectives due to the shift of a luminescent spot versus the product of the volume of a region projecting into the sealed glass chamber of the electrode bar and the volume of the region deposited on the pinch-sealed portion of the electrode bar.

With reference to an exemplary embodiment of this invention, an explanation will be given of the mode for carrying out this invention. FIGS. 1 to 8 show the first embodiment of this invention. FIG. 1 is a longitudinal cross sectional view of a discharge-lamp device use arc tube according to a first embodiment of this invention. FIG. 2 is an enlarged side perspective view of an electrode bar of the arc tube of FIG. 1. FIG. 3 is a graph showing the characteristic of flicker occurrence time (life of the arc tube) versus the volume of a region deposited on a pinch-sealed portion of the electrode bar. FIG. 4 is a graph showing the characteristics of the occurrence rate of foil float and longitudinal crack versus the volume of the region deposited on the pinch-sealed portion of the electrode bar. FIG. 5 is a graph showing the characteristics of the occurrence rate of defectives due to electrode consumption and of defectives due to the shift of a luminescent spot versus the volume of the region deposited on the pinch-sealed portion of the electrode bar. FIG. 6 is a graph showing the characteristics of the occurrence rate of defectives due to electrode consumption and of defectives due to the shift of a luminescent spot versus the product of the volume of a region projecting into the sealed glass chamber of the electrode bar and the volume of the region deposited on the pinch-sealed portion of the electrode bar. FIG. 7 is a view indicating the mechanism (chemical reaction) of flicker occurrence in the arc tube equipped with an electrode formed of a thoriated tungsten electrode bar. FIGS. 8A and 8B are views showing, in comparison, the enlarged longitudinal cross section crystal structure. FIG. 8A shows the electrode bar tip side region when a potassium-doped tungsten electrode bar is subjected to an aging process after vacuum heat-treatment within a range of 1200° C. to 2000° C. FIG. 8B shows when a thoriated tungsten electrode bar is subjected the same processing as FIG. 8A.

Figure 9:
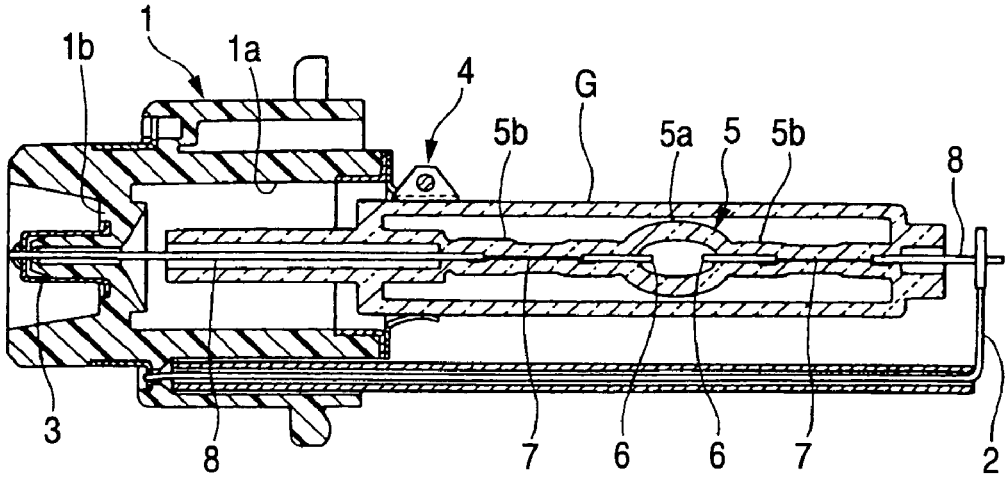
FIG. 9 is a longitudinal cross sectional view of a related art discharge lamp device.
Figure 10:
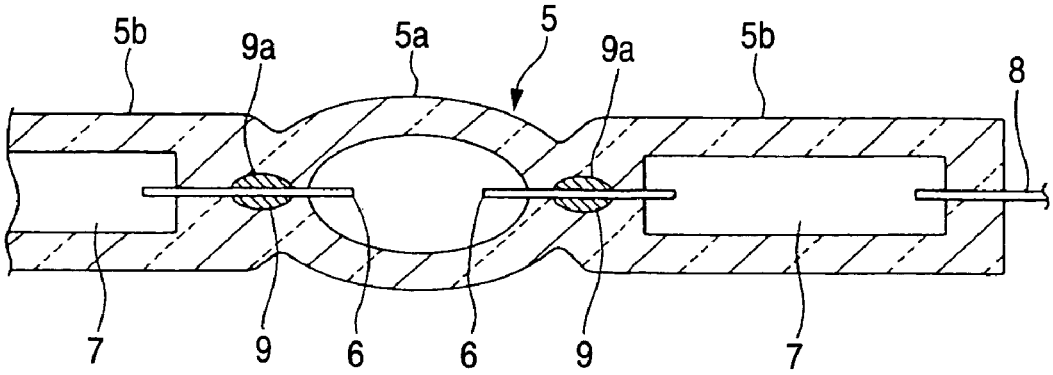
FIG. 10 is a longitudinal cross sectional view of a residual compressive distortion layer and a bead crack formed on a pinch-sealed portion of a related art arc tube according to JP-A-2001-15067.
Figure 11:
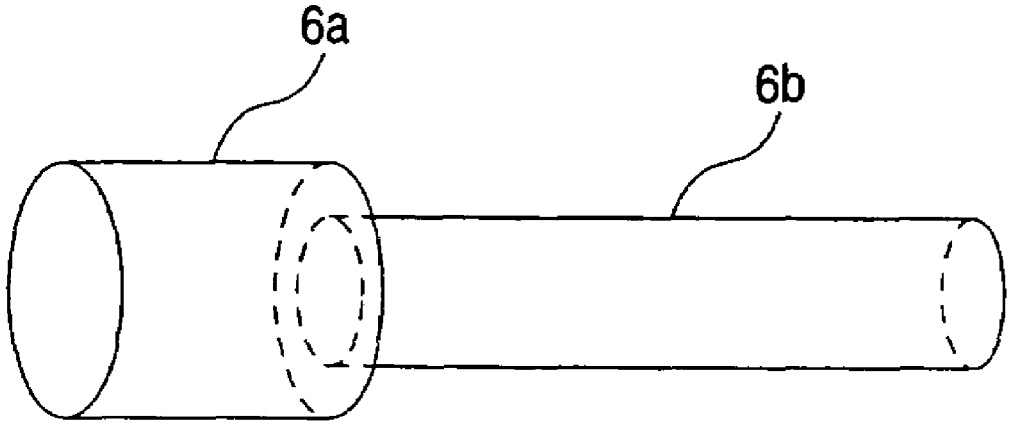
FIG. 11 is an enlarged perspective view of an electrode bar employed in a related art mercury-free arc tube according to JP-A-2005-142072 and JP-A-2005-183164.

In these figures, the discharge lamp device provided with an arc tube 10 has substantially the same structure as that of the related art discharge lamp as shown in FIG. 9 except that it employs a mercury-free arc tube operating at a rated power of 70 to 85 W (e.g., 75 W).

The arc tube 10 has a very compact structure in which in the longitudinal direction of a linearly extending portion of a circular-pipe shaped quartz glass tube, a spherical swelling portion is formed, and the vicinities of the spherical swelling portion are pinch-sealed to form pinch-sealed portions 13, 13 each having a square shape in cross section at both ends of an elliptical or cylindrical tip-less sealed glass chamber 12 which makes a discharge space having an internal volume of 50 μl or less. The sealed glass chamber 12 is filled with a light emissive material (NaI, $ScI_3$) and a buffering metallic halide such as $ZnI_2$ or $ThI_4$ in lieu of Hg as well as rare gas for actuation (e.g., Xe gas).

Further, within the sealed glass chamber 12, tungsten electrode bars 14, 14 constituting discharge electrodes are oppositely arranged. Each of the electrode bars 14, 14 is connected to a molybdenum foil 17 deposited on the pinch-sealed portion 13. From the end of the pinch-sealed portion 13, 13, a molybdenum lead wire 18, 18 connected to the molybdenum foil 17, 17 is led out.

Reference numerals 20 and 22 denote a residual compressive distortion layer and a bead crack formed around the electrode bar 14 in the pinch-sealed portion 13. The thermal stress generated in the interface between the electrode bar 14 (16) and the quartz glass layer when the arc tube is turned on is absorbed/dispersed by the residual compressive distortion layer 20 and the bead crack 22 so that it is conducted to the quartz glass layer. So, the longitudinal crack leading to leakage of the filled substance is suppressed from occurring in the quartz glass layer of the pinch-sealed portion 13.

Like the electrode employed in the mercury-free arc tube disclosed in JP-A-2005-183164, the electrode bar 14 is composed of a pillar-like tip side region 15 projecting into the sealed glass chamber 12 and having a large outer diameter d and a pillar-like base side region 16 deposited on the pinch-sealed portion 13 and having a small outer diameter D (<d), which constitute a stepped pillar continued concentrically, and also the ratio a/A of the cross sectional area a of the tip side region 15 to the cross sectional area A of the base side region 16 deposited on the pinch-sealed portion 13 is within a range of 1.1 to 7.3.

More specifically, as the outer diameter d is large, the electrode bar tip side region 15 projecting into the sealed glass chamber 12 has a larger thermal capacity and so suffers from less injury such as consumption or blackening of the electrode. For this reason, the outer diameter d is desirably as large as possible (e.g., 0.3 to 0.4 mm) within a range not exceeding the upper limit 0.4 mm of the outer diameter standard for the pillar-like electrode for the same kind of arc tube. Incidentally, if the outer diameter d is too large, the thermal capacity of the electrode is also too large so that consumption of thermal energy at the electrode tip will increase and consumption of optical energy, i.e., energy efficiency will be deteriorated. However, this is not problematic as long as the outer diameter d does not exceed the upper limit 0.4 mm of the outer diameter standard for the tungsten electrode of the arc tube.

On the other hand, the outer diameter D of the electrode bar base side region 16 deposited on the pinch-sealed portion 13 is desirably so small (e.g., 0.1 to 0.3 mm) that the thermal stress generated in the quartz glass layer of the pinch-sealed portion 13 when the arc tube is turned on/off is small.

Specifically, in order to compensate for the sealed glass chamber not being filled with mercury, in the mercury-free arc tube, the filling pressure of rare gas (e.g., Xe) is set at 10 to 15 atm, which is higher than in the mercury-sealed arc tube (generally 5 to 8 atm); the actuating voltage for acquiring the tube electric power necessary to discharging is set at 70 to 85 W, which is higher than in the mercury-sealed arc tube (generally, 60 to 70 W); and the current (tube current) supplied to the arc tube is set at 2.7 to 3.2 A, which is higher than in the mercury-sealed arc tube (generally, 2.2 to 2.6 A). As a result, since the load acting on the electrode increases and the electrode is likely to be injured, the total volume (capacity) of the electrode bar 14 is set at 0.4 to 0.6 $mm^3$, which is larger than in the mercury-sealed arc tube (generally, 0.25 to 0.35 $mm^3$). Further, the electrode bar tip region 15 which may be injured most severely, since it has the larger diameter, is correspondingly resistant to injury. On the other hand, if the electrode bar base side region 16 deposited on the pinch-sealed portion 13 has the larger diameter (too thick), as the case may be, the residual compressive layer and bead creak optimum to absorb/alleviate the thermal stress generated when the arc tube is turned on cannot be formed around the electrode bar 16 in the pinch-sealed portion 13. Thus, the longitudinal crack leading to leakage of the filled substance may be formed in the pinch-sealed portion owing to the thermal stress generated when the arc tube is tuned on/off. However, since the outer diameter D of the electrode bar base side region 16 is smaller than the outer diameter d of the electrode bar tip-side region 15, the residual compressive distortion layer 20 (bead crack 22) having a certain size is formed around the electrode bar 16. So, the occurrence of longitudinal cracks is correspondingly suppressed in the pinch-sealed portion 13.

As described above, in this embodiment, as in the case of JP-A-2005-183164, the injury of the electrode bar 14 and occurrence of the longitudinal crack in the pinch-sealed portion 13 can be suppressed to a degree in a structure of the electrode bar 14 having a stepped-shape in which the diameter d of the tip side region 15 projecting into the sealed glass chamber 12 is larger than the outer diameter D of the base side region 16, that is, the outer diameter D of the base side region 16 is smaller than the diameter d of the tip side region 15.

However, in order to surely suppress occurrence of flicker and occurrence of longitudinal cracks and foil float in the pinch-sealed portion 13, that is, realization of the long life of the arc tube, it is necessary to place the volume V of the region 16A (hereinafter referred to as an electrode embedded region) deposited on the pinch-sealed portion 13 of the electrode bar base side region 16 having the small diameter within a range from 0.25 to 0.42 $mm^3$.

More specifically, assuming that the cross sectional area of the small-diameter base side region 16 (electrode embedded region 16A) of the stepped electrode bar 14 is A, the length of the electrode embedded region 16A is L, the volume (capacity) of the electrode embedded region 16A is V, and the region projecting into the sealed glass chamber (hereinafter referred to as an electrode projecting region) 15A of the electrode bar is v, as the volume V (=A·L) of the electrode-embedded region 16A is increased, thermal conduction from the electrode bar to the pinch-sealed portion is promoted so that the temperature of the electrode tip side region 15A does not become excessively high. Thus, the deformation of the electrode and occurrence of flicker are suppressed. Further, in the characteristic of a flicker occurrence time (time taken until flicker occurrence after the arc tube has been turned on; the average life of the arc tube) versus the volume V, as shown in FIG. 3, if the limit of the flicker occurrence time (average life of the arc tube) is set at 2500 hours (generally desired), it can be seen that V is desirably 0.25 $mm^3$ or more.

Further, if the volume V (=A·L) of the electrode-embedded region 16A is increased, since the heat capacity of the electrode embedded region 16A is relatively large so that the temperature of the molybdenum foil 17 connected to the electrode bar 14 (16) does not rise correspondingly. Thus, the thermal stress generated between the glass layer and the molybdenum foil 17 is small and so occurrence of the foil float is correspondingly suppressed. In the characteristic of occurrence rate of the foil float versus V (see one-dot chain line in FIG. 4), if the limit of the occurrence rate of defectives is set at 0.5%, it can be seen that V is desirably 0.25 $mm^3$ or more.

In order to suppress occurrence of the longitudinal crack in the pinch-sealed portion 13, the residual compressive distortion layer 20 and bead crack 22 formed around the electrode embedded region 16A are desirably formed within an optimum range. For example, although the bead crack 22 extends in an arc shape around the electrode bar 16, the radius of the arc is ¼ or less of the width of the short side of the cross section of the pinch-sealed portion. If the volume (capacity) of the electrode embedded region 16A is too large, the circumferential and axial areas of the interface between the glass layer and the electrode embedded region 16A are large. Thus, in the process in which the pinch-sealed portion 13 is cooled after pinch-sealing, a difference in the quantity of heat-shrinkage between the electrode-embedded region 16A and the quartz glass layer becomes great, so that the residual compressive distortion layer and bead crack cannot be suitably formed in the quartz glass layer. Particularly, where the residual compressive distortion layer and the bead crack are large (for example, the radius of the arc of the bead crack exceeds ¼ of the width of the short side of the cross section of the pinch-sealed portion), when the arc tube is turned on, the crack extending radially from the end in the circumferential direction of the bead crack is generated, that is, the longitudinal crack is generated. In the characteristic of the occurrence rate of the longitudinal crack versus the volume (capacity) V of the electrode embedded region 16A (solid line in FIG. 4), if the limit of the occurrence rate of defectives is set at 0.5%, it can be seen that V is desirably 0.42 $mm^3$ or less.

As described above, in this embodiment, in order to surely suppress occurrence of flicker and occurrence of the longitudinal crack and the foil float in the pinch-sealed portion 13 so as to realize the long life of the arc tube, the volume V of the electrode embedded region 16A of the electrode bar 14 is placed within a range from 0.25 to 0.42 $mm^3$.

Further, in this embodiment, the sum of the volume (capacity) V of the electrode embedded region 16A and the volume (capacity) v of the electrode projecting region 15A, i.e., the total volume (V+v) of the electrode bar 14 is within a range of 0.40 to 0.60 $mm^3$ and the product (V·v) of the volume (capacity) V of the electrode embedded region 16A and the volume (capacity) v of the electrode projecting region 15A is within a range of 0.03 to 0.09 $mm^3$ so that both the occurrence rate of defectives due to consumption of the electrode and that due to shift of the luminescent spot of the arc are 0.5% or less.

More specifically, if the total volume (V+v) of the electrode bar 14 is too small, the thermal capacity of the electrode is also too small so that the electrode reaches an excessively high temperature and so is consumed. On the other hand, if the total volume (V+v) of the electrode bar 14 is too large, the thermal capacity of the electrode is also too large so that the electrode does not reach an appropriate temperature necessary for stable discharging thus leading to the shift of the luminescent spot. In the characteristic of the occurrence rate of defectives (electrode consumption) (see solid line in FIG. 5) and the occurrence rate of defectives (shift of the luminescent spot) (see one-dot chain line in FIG. 5) versus the total volume (V+v) of the electrode bar 14, if the limit of their occurrence rate of defectives is set at 0.5%, it can be seen that the total volume (V+v) of the electrode bar 14 is desirably 0.03 $mm^3$ or more and 0.60 $mm^3$ or less.

Further, in order to further clarify the effective range (limit) for the electrode consumption and the shift of the luminescent spot, acquired are the occurrence rate of defectives (electrode consumption) (see solid line in FIG. 6) and occurrence rate of defectives (shift of the luminescent spot) (see one-dot chain line in FIG. 6) versus the product (V·v) of the volume (capacity) V of the electrode embedded region 16A and the volume (capacity) v of the electrode projecting region 15A. In this case, if the limit of both the occurrence rates due to the electrode consumption and the shift of the luminescent spot is set 0.5%, it can be seen that (V·v) is 0.03 $mm^6$ or more and 0.09 $mm^6$.

Further, the electrode bars 14 are made of tungsten doped with potassium, vacuum heat-treated previously within a temperature range of 1200° C. to 2000° C., and subjected to an aging process of repeating "ON" and "OFF" after the arc tube 10 has been completed so that the longitudinal cross section crystal structure of the electrode bar tip side region 15 constituting the electrode projecting region 15A of the electrode bar is formed of a non-sagging crystal structure and its tip is formed of a single crystal having a diameter approximately equal to that of the electrode bar tip side region 15. In accordance with such a structure, breakage of the electrode bar (large-diameter electrode bar tip side region 15) can be suppressed and occurrence of the flicker (arc flicker) can be further suppressed.

Specifically, each the electrode bars 14 oppositely provided within the sealed glass chamber 12 was traditionally formed of an electrode bar made of thoriated tungsten (generally referred to as "thori-tun"). So, owing to the thoria ($ThO_2$) contained in the tungsten, flicker (arc flicker) is likely to occur. FIG. 7 is a view indicating the mechanism (chemical reaction) of flicker occurrence in the thoriated tungsten electrode bar in the mercury-free arc tube having, as the opposite electrodes, the thoriated tungsten electrode bars. In this chemical reaction, it is supposed that owing to deformation of the electrode and vanishing of thoria, a re-ignition voltage rises so that flicker occurs. Further, the electrode bar 14 can be given a predetermined stepped shape by forming the one end (base side region 16) of a pillar-like electrode bar having a uniform outer diameter d into the pillar-like shape having an outer diameter D e.g., by cutting. In this case, since the cutting processing is required, impurities will be deposited on or water will be absorbed by the surface of the electrode bar 14. So, flicker is more likely to occur.

However, the stepped electrode bar 14 according to this embodiment is not a thoriated tungsten electrode bar, but a potassium-doped tungsten electrode bar 14 in which the flicker (arc flicker) will not occur owing to thoria ($ThO_2$).

Further, the potassium-doped tungsten stepped electrode bar 14 is previously subjected to vacuum heat-treatment within a temperature range of 1200° C. to 2000° C. before pinch sealing so that the impurities deposited or the water absorbed on the electrode surface are removed. By subjecting the electrode bar to the vacuum heat-treatment, the longitudinal cross sectional crystal structure of the entire region of the electrode bar 14 becomes a textile crystal structure which has an excellent strength and so is difficult to break. Further, since the potassium-doped tungsten electrode bar 14 subjected to the vacuum heat treatment experiences an aging process of repeating "ON" and "OFF" after the arc tube 10 has been completed, the longitudinal cross section crystal structure of the electrode bar tip side region 15 constituting the electrode projecting region 15A is formed of a non-sagging crystal structure in which the textile crystal before the aging process has grown (has become coarse) as shown in FIG. 8A. This non-sagging crystal structure is excellent in strength, particularly against a transversally acting load, such as vertical vibration.

Particularly, the tip of the electrode bar tip side region 15 having experienced the aging process is formed of a single crystal structure grown (become coarse) so as to be apparently different from the non-sagging crystal. This structure is resistant to the decline of the luminescent spot during discharging and so is resistant to the generation of flicker (arc flicker). More specifically, in the mercury-free arc tube, in order that the tube electric power necessary for discharging is obtained, it is necessary to increase the current (tube current) to be supplied to the arc tube, thereby increasing the tube electric power. The electrode tip correspondingly reaches a high temperature. Therefore, if the ON/OFF of the arc tube is repeated, the crystal in the vicinity of the electrode tip will grow (crystal size will expand) so that the face shape of the electrode tip changes owing to shifting of a crystal interface position. Thus, the "decline" of the luminescent spot, such as displacement of the luminescent spot or shift of the luminescent spot, occurs. This makes it difficult to acquire the appropriate distributed light and to reduce the central brightness of a vehicle-use head lamp. However, in accordance with this embodiment, since the electrode bar tip is formed of a single structure C1 having a diameter equal to that of the tip side region 15, the electrode end face shape does not greatly change. So, even if the electrode bar tip is gradually consumed, the entire electrode end face shape (end face shape of the single crystal) is consumed nearly uniformly. Accordingly, the decline of the luminescent spot during discharging leading to flicker (arc flicker) is suppressed.

FIG. 8B shows the enlarged longitudinal cross sectional crystal structure of the tip side region of the thoriated tungsten stepped electrode bar subjected to the same processing for the potassium-doped tungsten stepped electrode bar 14 of FIG. 8A. The potassium-doped tungsten stepped electrode bar 14 is a thoriated tungsten electrode bar vacuum heat-treated previously within a temperature range of 1200° C. to 2000° C. before pinch-sealing, and thereafter subjected to the aging process after the arc tube has been completed. As seen from FIG. 8B, since the entire electrode bar tip side region 15 inclusive of its tip constituting the electrode projecting region 15A is formed of the non-sagging crystal structure, the decline of the luminescent spot is likely to occur during discharging and so flicker (arc flicker) is also likely to occur. It can be seen that the longitudinal cross section crystal structure of the tip side region of the potassium-doped tungsten electrode whose tip is formed of the single crystal C1, shown in FIG. 8A, is apparently different from the longitudinal cross sectional crystal structure (see FIG. 8B) of the tip side region of the thoriated tungsten electrode bar inclusive of its tip which is formed of the non-sagging crystal structure.

The mercury-free arc tube 10 can be manufactured as follows. Previously prepared is an electrode assembly in which a stepped electrode bar 14 subjected to vacuum heat treatment (1200° C. to 2000° C.), a molybdenum foil 17 and a lead wire 18 are connected/integrated linearly. The electrode "assy" is passed and held in each of the opening ends of a glass tube in which the glass chamber has been formed. The opening ends of the glass tube are pinch-sealed so that the sealed glass chamber is filled with a halide of Na or Sc and buffering metallic halide such as $ZnI_2$ or $Thi_4$ in lieu of Hg as well as rare gas for actuation (e.g., Xe gas).

While the invention has been described in connection with the exemplary embodiments, it will be obvious to those skilled in the art that various changes and modification may be made therein without departing from the present invention, and it is aimed, therefore, to cover in the appended claim all such changes and modifications as fall within the true spirit and scope of the present invention.

What is claimed is:

1. A mercury-free arc tube for a discharge-lamp device comprising:

a sealed glass chamber in which at least a metallic halide and a rare gas are pinch-sealed by pinch-sealed portions provided at both end openings of a glass tube; and electrode bars that are provided so as to oppose each other and respectively comprising:

a tip side region that projects into the sealed glass chamber; and a base side region provided in the pinch-sealed portion, wherein the electrode bars have a shape such that a cross sectional area of the tip side region is larger than that of the base side region, and a volume V of the base side region provided in the pinch-sealed portion is from 0.25 to 0.42 $mm^3$.

2. The mercury-free arc tube for the discharge-lamp device according to claim 1, wherein when the volume of the tip side region of the electrode bar that projects into the sealed glass chamber is v, V+v is from 0.40 to 0.60 $mm^3$.

3. The mercury-free arc tube for the discharge-lamp device according to claim 1, wherein the electrode bars are potassium-doped tungsten electrode bars, which have been vacuum heat-treated in a temperature range of 1200° C. to 2000° C. and which, after assembling the arc tube, have been subjected to an aging process of repeating "ON" and "OFF", wherein a longitudinal cross sectional crystal structure of the tip side region of the electrode bars is formed of a non-sagging crystal structure, and wherein a tip portion of the tip side region of the electrode bars is formed of a single crystal having a diameter approximately equal to that of the tip side region of the electrode bars.

4. The mercury-free arc tube for the discharge-lamp device according to claim 1, wherein the electrode bars have a concentric stepped shape.

5. The mercury-free arc tube for the discharge-lamp device according to claim 2, wherein the product of V multiplied by v is in the range of 0.03 to 0.09 $mm^6$.

6. The mercury-free arc tube for the discharge-lamp device according to claim 1, wherein the filling pressure of the rare gas is 10 to 15 atm, the actuating voltage for discharge is 70 to 85 W and the current supplied to the arc tube is 2.7 to 3.2 A.

7. The mercury-free arc tube for the discharge-lamp device according to claim 1, wherein the outer diameter d of the tip side region of the electrode bars is less than or equal to 0.4 mm and wherein the outer diameter D of the base side region of the electrode bars is 0.1 to 0.3 mm.

8. The mercury-free arc tube for the discharge-lamp device according to claim 1, further comprising a residual compressive distortion layer and a bead crack formed around electrode bars at the pinch sealed portions.

9. A mercury-free arc tube for a discharge-lamp device comprising:

a sealed glass chamber in which at least a metallic halide and a rare gas are pinch-sealed by pinch-sealed portions provided at opposite end openings of a glass tube; and electrode bars that are provided so as to oppose each other and respectively comprising:

a tip side region that projects into the sealed glass chamber; and a base side region that is provided in the pinch-sealed portion, wherein the electrode bars are potassium-doped tungsten electrode bars which have been vacuum heat-treated at a temperature range of 1200 °C to 2000 °C and which, after assembling the arc tube, have been subjected to an aging process of repeating "ON"and "OFF";

wherein a longitudinal cross sectional crystal structure of the tip side region of the electrode bar is formed of a non-sagging crystal structure; and wherein a tip portion of the tip side region of the electrode is formed of a single crystal having a diameter approximately equal to that of the tip side region of the electrode bar, wherein the electrode bars have such a shape such that a cross sectional area of the tip side region is larger than that of the base side region, and wherein a volume V of the base side region deposited on the pinch-sealed portion is in the range of 0.25 to 0.42 $mm^3$.

10. The mercury free arc tube for the discharge lamp device according to claim 1, wherein the metallic halide is for main light emission.

11. The mercury free arc tube for the discharge lamp device according to claim 9, wherein when the volume of the tip side region of the electrode bar that projects into the sealed glass chamber is v, V+v is from 0.40 to 0.60 $mm^3$.

12. The mercury free arc tube for the discharge lamp device according to claim 11, wherein the product of V multiplied by v is in the range of 0.03 to 0.09 $mm^6$.

* * * * *